US006676510B1

(12) United States Patent
Bittman et al.

(10) Patent No.: US 6,676,510 B1
(45) Date of Patent: Jan. 13, 2004

(54) ELECTRONIC GAMING DEVICE HAVING RANDOM REEL MAPPING

(75) Inventors: Robert A. Bittman, Carson City, NV (US); Anisur Chowdhury, Reno, NV (US)

(73) Assignee: IGT, Reno, NV (US)

( * ) Notice: Subject to any disclaimer, the term of this patent is extended or adjusted under 35 U.S.C. 154(b) by 147 days.

(21) Appl. No.: 09/799,661

(22) Filed: Mar. 6, 2001

(51) Int. Cl.[7] ..... G07F 17/34
(52) U.S. Cl. ..... 463/20; 273/143 R
(58) Field of Search ..... 463/16–20, 21–22; 273/138.1, 138.2, 143 R

(56) References Cited

U.S. PATENT DOCUMENTS

| | | | | | |
|---|---|---|---|---|---|
| 4,095,795 | A | | 6/1978 | Saxton et al. | 273/143 |
| 4,448,419 | A | | 5/1984 | Telnaes | 273/143 |
| 4,573,681 | A | * | 3/1986 | Okada | 463/21 |
| 4,889,339 | A | * | 12/1989 | Okada | 273/143 R |
| 5,074,559 | A | * | 12/1991 | Okada | 273/143 R |
| 5,584,764 | A | * | 12/1996 | Inoue | 273/143 R |
| 5,667,219 | A | * | 9/1997 | Ishibashi | 273/143 R |
| 5,683,296 | A | * | 11/1997 | Rasmussen | 463/20 |
| 5,785,595 | A | * | 7/1998 | Gauselmann | 463/20 |
| 5,788,573 | A | | 8/1998 | Baerlocher et al. | 463/16 |
| 5,839,957 | A | * | 11/1998 | Schneider et al. | 463/20 |
| 5,863,249 | A | * | 1/1999 | Inoue | 463/20 |
| 5,879,234 | A | * | 3/1999 | Mengual | 463/20 |
| 5,938,196 | A | * | 8/1999 | Antoja | 273/143 C |
| 5,984,781 | A | * | 11/1999 | Sunaga | 463/20 |
| 5,988,638 | A | * | 11/1999 | Rodesch et al. | 273/143 R |
| 6,003,867 | A | * | 12/1999 | Rodesch et al. | 273/143 R |
| 6,168,520 | B1 | | 1/2001 | Baerlocher et al. | 463/16 |

FOREIGN PATENT DOCUMENTS

| | | | | |
|---|---|---|---|---|
| JP | 11333051 | A | * 12/1999 | A63F/5/04 |
| JP | 2000140194 | A | * 5/2000 | A63F/5/04 |
| JP | 2000185129 | A | * 7/2000 | A63F/5/04 |

* cited by examiner

*Primary Examiner*—Teresa Walberg
*Assistant Examiner*—Scott E. Jones
(74) *Attorney, Agent, or Firm*—Marshall, Gerstein & Borun LLP

(57) ABSTRACT

A method and apparatus for use in a gaming apparatus having a plurality of reels, wherein each reel includes a plurality of physical stops associated with a plurality of symbols is disclosed. The method and apparatus maps random numbers to the plurality of physical stops on the plurality of reels in a random manner.

49 Claims, 12 Drawing Sheets

ELECTRONIC GAMING DEVICE HAVING RANDOM REEL MAPPING

TECHNICAL FIELD

The present invention is directed to electronic gaming devices and, more particularly, to electronic gaming devices having flexible reel mapping that maps random numbers to physical stops on reels of the electronic gaming devices.

BACKGROUND ART

Conventional slot machine games allow a user to wager on the positions at which spinning reels of the slot machine will stop. For example, conventional slot machines have symbols disposed on the outer periphery of each of the reels. The rotational positions of the symbols with respect to a payline of the machine dictate the outcome of the game and how much, if any, money the machine will payout to the user. While historically slot machines utilized mechanical components such as gears, weights and levers, today slot machines, as well as numerous other gambling games, may be implemented on a microprocessor-based platform.

Such gambling games typically utilize a microprocessor to control various functional aspects of the machine. For example, a microprocessor may control payouts, indicate machine malfunctions, track credits and control reels that display the outcome of a game to a user. In addition to its other functions, the microprocessor of a gaming device may also determine the outcome of a particular game and display the game outcome to the user. For example, after a user wagers value and pulls a spin lever of a gaming device, the gaming device generates random numbers and maps the random numbers to rotational positions on the reels. The gaming device then stops the reels at rotational positions to display symbols on a payline and determines the outcome of the game based on the rotational positions of the reels. Commonly, a first random number is mapped to the leftmost reel and subsequent numbers are mapped to subsequent reels from left to right. During game play, the microprocessor stops the spinning reels of the gaming device from left to right, from the perspective of the user.

Typically, the leftmost reel has the highest odds of displaying a high payout symbol on the payline and the rightmost reel has the lowest (or longest) odds of displaying a high payout symbol on the payline. For example, if a CHERRY is a high payout symbol, the leftmost reel may have one in five odds of displaying a CHERRY, while the rightmost reel may have one in one hundred odds of displaying a CHERRY. Accordingly, during game play, as high payout symbols appear at the payline on the reels from left to right, the user anticipates a high payout outcome for the game and may become very excited. However, as is commonly the case, even if each reel up to the rightmost reel displays a high payout symbol, the rightmost reel will rarely display the high payout symbol because the rightmost reel has the longest odds for displaying such a symbol.

The fixed assignment of random numbers to reels does not enhance the apparent randomness of the game outcome. Additionally, the assignment of the longest odds for a high payout symbol to the rightmost reel may be initially exciting to a user because the user may actually think that they are about to win a large payout before the rightmost reel stops. However, over time the user may become sensitized to the fact that while high payout symbols commonly appear on the leftmost reels, the rightmost reel rarely displays a high payout symbol. Accordingly, over time a user may become disinterested in playing the gaming apparatus.

SUMMARY OF THE EMBODIMENTS

According to one aspect, the present invention may be embodied in a method for use in a gaming apparatus having a plurality of reels, wherein each reel has a plurality of physical stops associated with a plurality of symbols. The method is for mapping random numbers to the plurality of physical stops on the plurality of reels. The method may include receiving a user input indicating a desire to start a game, spinning the plurality of reels and generating a random number. The method may further include randomly associating the random number with a selected reel of the plurality of reels, mapping the random number to one of the plurality of physical stops on the selected reel, stopping the plurality of reels from spinning so that the symbols on the reels indicate an outcome of the game and determining the outcome of the game based on the random number and the physical stop to which the random number was mapped.

The method may also include mapping the random number to an intermediate number that is randomly associated with the selected reel and mapping the intermediate number to one of the plurality of physical stops using a translation map.

According to a second aspect, the present invention may be embodied in a gaming apparatus including a plurality of reels, a plurality of physical stops associated with a plurality of symbols on each of the plurality of reels for displaying an outcome of a game to a user, a plurality of motors associated with the plurality of reels for spinning the reels and a user input device for indicating a desire to start a game. The gaming apparatus may also include a controller coupled to the plurality of motors and the user input device, and the controller may include a processor and a program memory. The controller may be programmed to receive a user input indicating a desire to start a game, to spin the plurality of reels, to generate a random number and to randomly associate the random number with a selected reel of the plurality of reels. The controller may also be programmed to map the random number to one of the plurality of physical stops on the selected reel, to stop the plurality of reels from spinning so that the symbols on the reels indicate an outcome of the game and to determine the outcome of the game based on the random number and the physical stop to which the random number was mapped.

According to a third aspect, the present invention may be embodied in a programmed memory that is capable of being used in connection with an electronic gambling unit that may include a processor, a plurality of reels, each reel having a plurality of physical stops associated with a plurality of symbols, for mapping random numbers to the plurality of physical stops on the plurality of reels. In such an embodiment, the programmed memory may include a first memory portion physically configured in accordance with computer program instructions that would cause the electronic gambling unit to receive a user input indicating a desire to start a game, a second memory portion physically configured in accordance with computer program instructions that would cause the electronic gambling unit to spin the plurality of reels and a third memory portion physically configured in accordance with computer program instructions that would cause the electronic gambling unit to generate a random number. The program memory may also include a fourth memory portion physically configured in accordance with computer program instructions that would cause the electronic gambling unit to randomly associate the random number with a selected reel of the plurality of reels and a fifth memory portion physically configured in accordance with computer program instructions that would cause the electronic gambling unit to map the random number to one of the plurality of physical stops on the selected reel. Further, the program memory may include a sixth memory portion physically configured in accordance with computer program instructions that would cause the electronic gambling unit to stop the plurality of reels from spinning so that the symbols on the reels indicate an outcome of the game and a seventh memory portion physically configured in accordance with computer program instructions that would cause the electronic gambling unit to determine the outcome of the game based on the random number and the physical stop to which the random number was mapped.

The invention itself, together with further objects and attendant advantages, will be best understood by one having ordinary skill in the art by reference to the following detailed description, taken in conjunction with the accompanying drawings.

DESCRIPTION OF THE PREFERRED EMBODIMENTS

Figure 1:
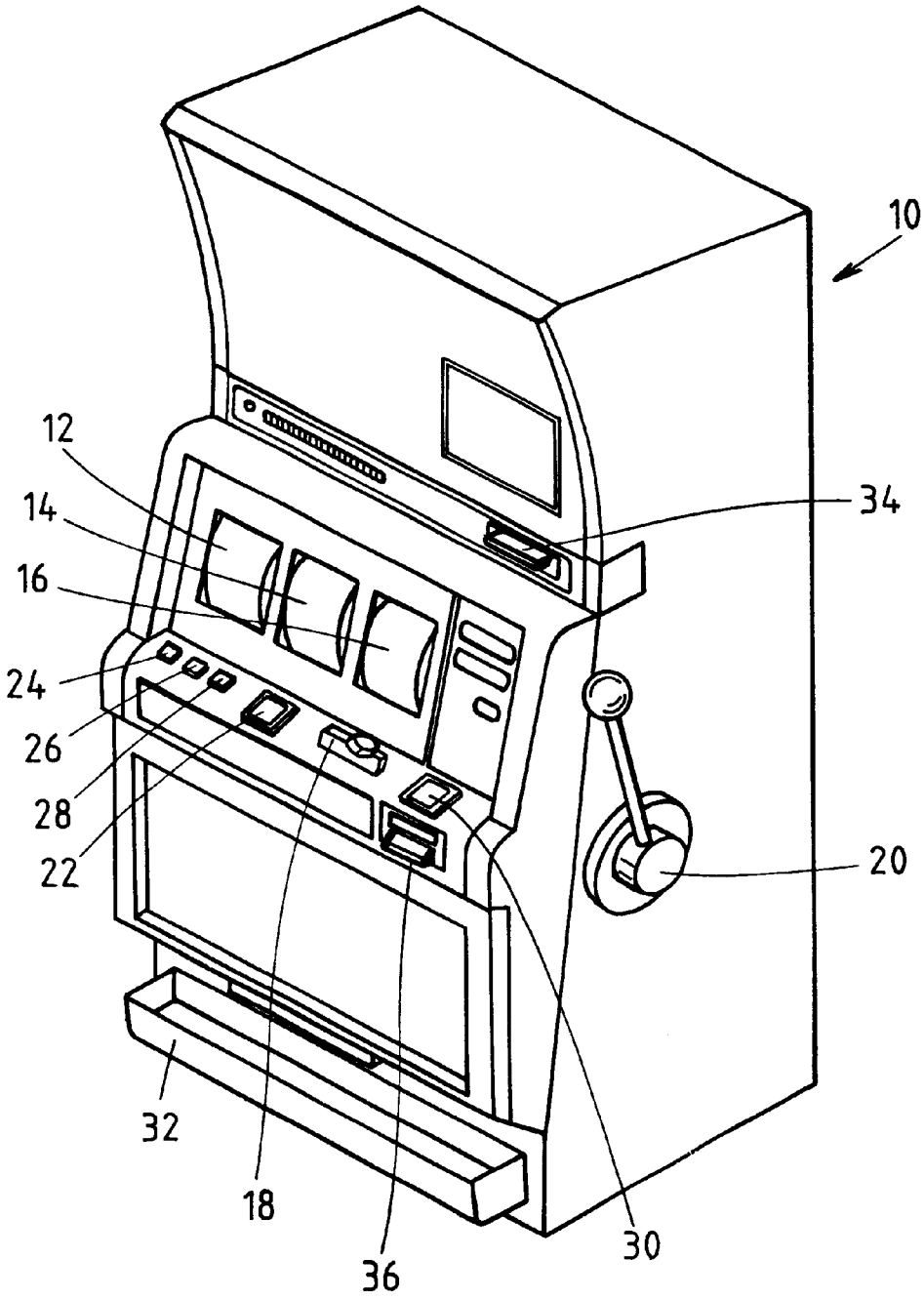
FIG. 1 is an exemplary drawing of a gaming apparatus in which the present invention may be implemented.

Turning now to the figures, as shown in FIG. 1, a gaming apparatus 10, such as a slot machine or any other like apparatus, may include a plurality of reels, which may be designated as a first reel 12, a middle reel 14 and a last reel 16 each of which has a plurality of symbols disposed thereon, a slot or opening 18 for accepting tokens, coins or any other suitable elements that may or may not be representative of monetary value, a handle or arm 20 and a spin button 22 (either of which may be referred to as a spin actuator). The gaming apparatus 10 may also include a number of buttons 24–30 that a user may actuate to make bets or wagers, a payout tray or hopper 32, a card acceptor 34 and a bill acceptor 36.

During typical use of the gaming apparatus 10, a user inserts into the gaming apparatus 10 value that the user may bet. For example, a user may deposit tokens or coins via the slot 18, may insert a card having information representative of value into the card acceptor 34 or may insert a monetary bill or voucher into the bill acceptor 36. The following description refers to value being inserted into and dispensed from the gaming apparatus 10. As used herein the term "value" is intended to encompass conventional tokens, coin or bill currency or any other suitable objects that may be representative of some monetary value. Furthermore, as used herein, the term value may include cards having value associated therewith (e.g., printed cards, smart cards, vouchers or the like). Once the gaming apparatus 10 recognizes that the user has deposited value, the user may make a wager using the buttons 24–30, which may allow the user to wager various units of value on the outcome of the game. After making a wager, the user begins a game either by pulling the arm 20 or by actuating the spin button 22, either of which causes the gaming apparatus to spin the reels 12–16 for a period of time.

As the reels 12–16 spin, the gaming apparatus 10 selects random numbers that will be used to stop the reels at particular positions. Typically, the reels are stopped in sequence from left to right from the perspective of the user. For example, conventionally, the first reel 12 would be stopped first, followed by the middle reel 14 and the last reel 16. As the reels 12–16 are stopped, symbols representative of the game outcome, which are disposed on the periphery of the reels 12–16, are displayed to the user. After each of the reels has stopped, the gaming apparatus determines the outcome of the game. For example, if the gaming apparatus 10 determines that the combination of symbols displayed to the user is a "winner," a winner is declared and the gaming apparatus 10 pays out by dispensing value to the user. The concept of dispensing value may include dropping tokens into the payout tray 32, adding value to a card placed in the card acceptor 34, accumulating value for the user within the gaming apparatus 10 printing a ticket or voucher or any other suitable technique of distributing value to a user. If the outcome of the game is a winner, the game ends after the gaming apparatus 10 pays out. However, if the outcome of the game is not a winner, the gaming apparatus 10 does not pay out and the game simply ends with the user losing the wagered value.

Figure 2:
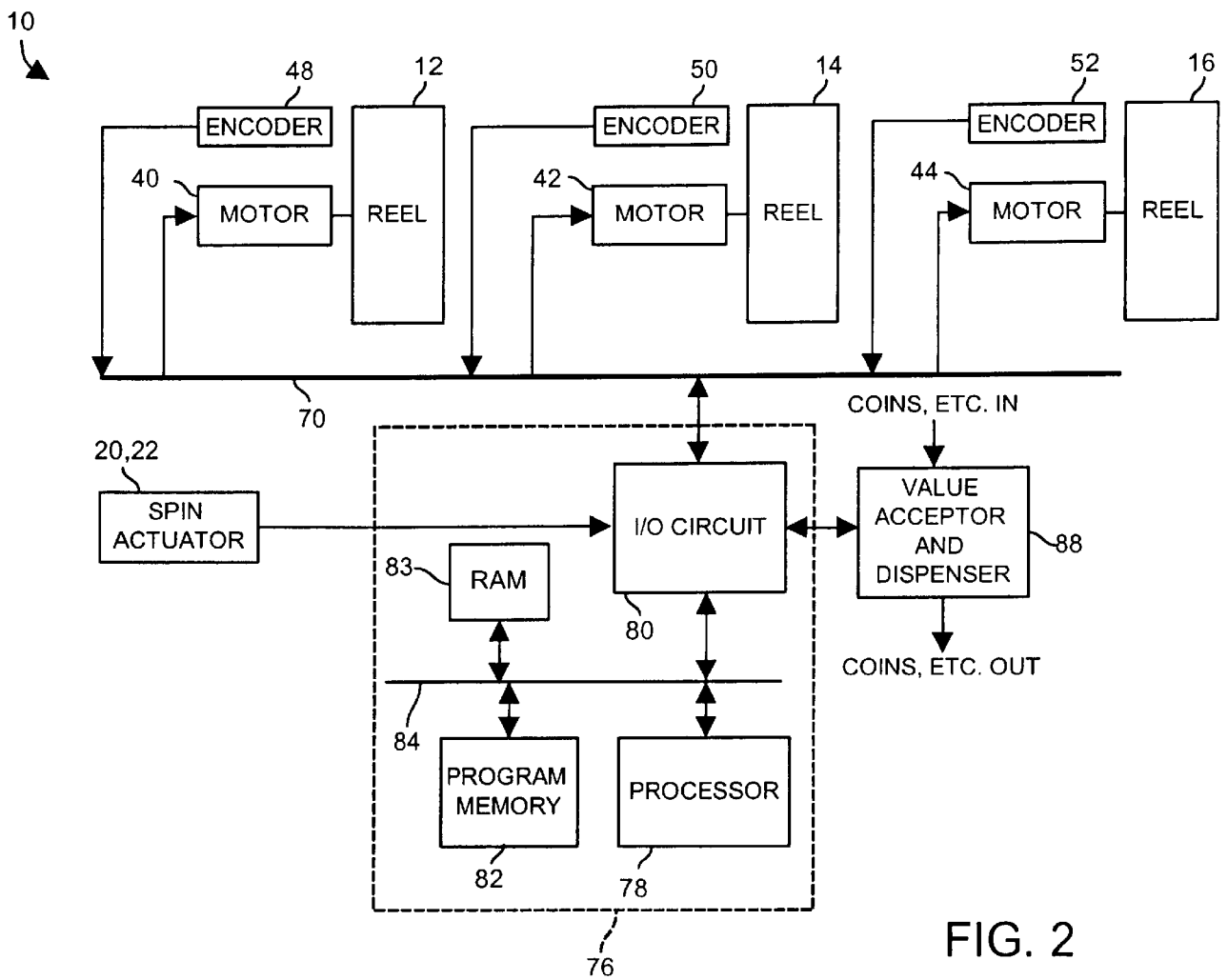
FIG. 2 is an exemplary hardware block diagram of the gaming apparatus of FIG. 1.

FIG. 2 reveals that the reels 12–16 may have associated motors 40–44 for spinning the reels 12–16 about their axes. The motors 40–44 may be stepper motors such as an ASTROSYN Miniangle Stepper type motor bearing model number 34PM-C007-14, which is available from Minebea Co. LTD. Alternatively, as will be appreciated by those having ordinary skill in the art, other types of motors may be used. The use of such stepper motors enables the rotational position of the motors 40–44 and the reels 12–16 to be controlled precisely to display a particular combination of symbols to a user. Alternatively, rather than using a number of motors to spin the reels 12–16, a single motor may be used to spin all of the reels 12–16. The reels 12–16 may also have associated encoders 48–52 that sense the rotational positions of the reels 12–16. As will be readily appreciated by those having ordinary skill in the art, while the reels 12–16 may be physical reels that spin, the reels may alternatively be embodied in electronic reels that display symbols to the user via electronic display technology such as, for example, a light emitting diode (LED) display, a liquid crystal display (LCD) or any other suitable display technology.

Each of the motors 40–44 and the encoders 48–52 may be communicatively coupled to a communications bus 70, to which a controller 76 may also be communicatively coupled. Alternatively, the motors 40–44 and the encoders 48–52 may be coupled directly to the controller 76, rather than using the communications bus 70. The controller 76 may be embodied in hardware that is commercially available in, for example, the International Game Technology "I-Game" platform for video gambling machines that uses an associated Intel 8032-based daughter board to control reel spinning and stopping activities. In particular, the controller 76 may be embodied in a 16 or 32-bit, 16 megahertz (MHz) 80C960SA microcontroller, which is commercially available from Intel or any other suitable source, or may be embodied in any other suitable microcontroller or microprocessor. By way of further example, the controller 76 may also be embodied in the International Game Technology "S2000" gaming platform for spinning reel gambling machines.

As shown in detail in FIG. 2, the controller 76 may include a processor 78 that is communicatively coupled to an input/output (I/O) circuit 80, a program memory 82 and a random access memory (RAM) 83 via a bus 84. The program memory 82 of the controller 76 may be RAM, read only memory (ROM) or any suitable combination thereof. Alternatively or additionally, an additional memory may be communicatively coupled to the controller 76. For example, a memory such as any one, or any suitable combination, of an erasable programmable read only memory (EPROM), an electrically erasable programmable read only memory (EEPROM), a one time programmable read only memory (OTP), a static random access memory (SRAM), FLASH or any other suitable memory element may be externally connected to the controller 76. Further, any form of data storage media may be used in conjunction with the controller 76. For example, magnetic media (e.g., hard disks, floppy disks and the like) or optical media (e.g., compact disks, digital video disks and the like) may be coupled to the controller 76.

As will be appreciated by those having ordinary skill in the art, the instructions for carrying out the various functions of the gaming apparatus 10 may be written in any suitable high level computer language, such as, for example, C or C++, and may be compiled into a form that may be stored in the program memory 82 and executed by the processor 78. Alternatively, the instructions may be written in assembly or machine language form and may be compiled into a form that may be stored in the program memory 82.

As shown in FIG. 2, the gaming apparatus may also include a value acceptor and dispenser 88 that may be communicatively coupled to the processor 78 via the I/O circuit 80. The value acceptor and dispenser 88 may accept tokens, coins, bills, vouchers or cards representing value and may output coins, tokens and the like or may write data representative of value onto a card such as a smart card, a printed ticket or a voucher. For example, a user may deposit tokens into the value acceptor and dispenser 88, via the slot 18, to allow the user to play a game. Additionally, the value acceptor and dispenser 88 may dispense tokens into the payout tray 32 if the user wins a game.

In general, the processor 78 of the controller 76 is adapted to interact with the program memory 82 to cause the controller 76 to carry out the functionality of the gaming apparatus 10. During operation, the value acceptor and dispenser 88 informs the controller 76 when a user inputs value into the gaming apparatus 10. After the controller 76 is aware that value has been input into the gaming apparatus 10, the controller 76 monitors the spin actuators 20, 22, which inform the controller 76 when the user desires to play a game. When the controller 76 receives an indication from one of the spin actuators 20, 22 that a user desires to play a game, the controller 76 controls the motors 40–44 to cause the reels 12–16 to spin. After spinning the reels 12–16 for a predetermined time, the controller 76 selects random numbers and controls the motors 40–44 to stop the reels 12–16 at appropriate rotational positions, which may correspond directly or indirectly to the selected random numbers, to inform the user of the outcome of the game. After the reels 12–16 have stopped, the controller 76 determines whether the user has won the game. Further detail regarding the programming of the controller 76 and the program memory 82 to carry out the functions of the gaming apparatus 10 is provided hereinafter.

While FIG. 2 illustrates multiple sets of hardware that may each include a reel, an encoder and a motor, portions of the subsequent description of the invention may at times refer only to a set of hardware including the first reel 12, the motor 40 and the encoder 48. It should be understood that such references are made to a single set of hardware only for the ease of description and that each set of hardware may be substantially identical to any single set of hardware described hereinafter.

Figure 3:
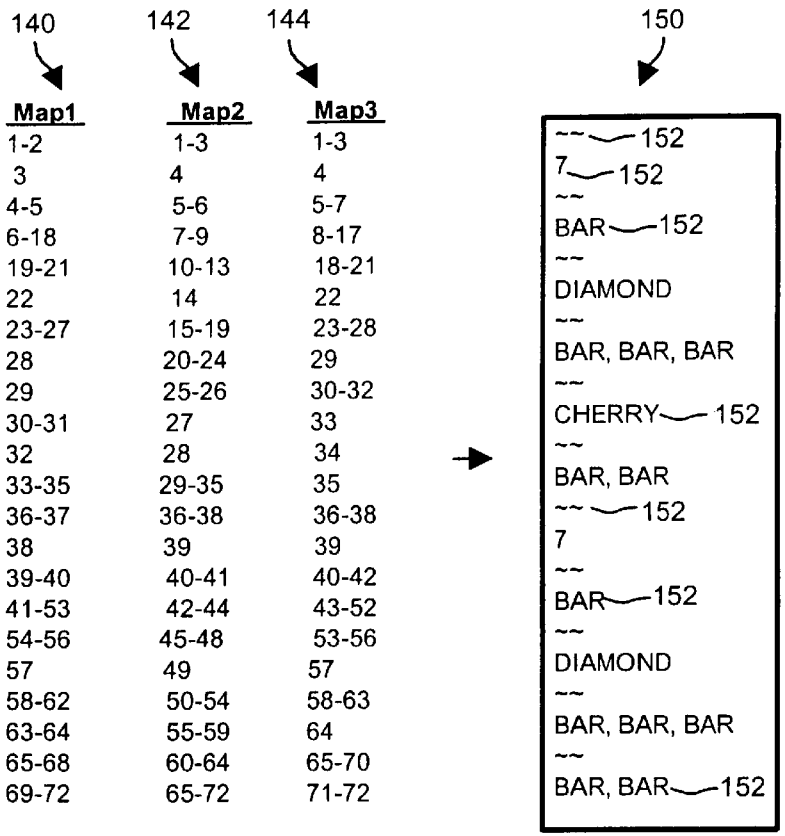
FIG. 3 is an exemplary drawing of a reel strip (3B) that may be installed on the reels of FIGS. 1 and 2 and three exemplary maps (3A) that may be used to map virtual stops to physical stops on the reels.

As shown in FIG. 3, a first map 140, a second map 142 and a third map 144 (shown in FIG. 3A as map 1, map 2 and map 3) may be used to map virtual stops to physical stops on reels, which include reel strips (e.g., the reel strip 150 of FIG. 3B) having symbols 152 disposed thereon. Further detail regarding the operation of mapping virtual stops to physical stops is provided in U.S. Pat. No. 4,448,419 to Telnaes, which is owned by International Game Technology, the assignee of the present patent. FIG. 3B illustrates the reel strip 150 as one that has been taken off of a reel, cut from its cylindrical shape and laid flat. For example, as shown in FIG. 3B, the GHOST or blank symbol (represented by "~~" in the drawings for ease of description) at the top of the reel strip 150 is actually the space between the symbol 7 below the GHOST symbol and the symbol BAR BAR at the bottom most portion of the reel strip 150. The maps 140–144 may be different from one another as shown in FIG. 3A or, in other embodiments, two or more of the maps may be identical. For example, the number of different maps may correspond to the number of reels used by a gaming apparatus. Alternatively, more or fewer maps may be used to map virtual stops to physical stops. As represented in FIG. 3, each row of numbers shown on the maps 140–144 corresponds to a range of virtual stops that correspond to symbols 152 on the reel strip 150. For example, virtual stops between 1 and 2, 1 and 3 and 1 and 3 correspond to a GHOST symbol 152 for the first second and third maps 140–144, respectively.

As will be appreciated, the odds of a particular virtual stop corresponding to a particular physical stop may be varied based on the map used to map a virtual stop to a physical stop. For example, FIG. 3 illustrates that the odds of a virtual stop being mapped to the topmost BAR BAR BAR symbol are five times as great for the second map 142 than for either of the first or third maps 140 and 144, respectively. Different maps (e.g., 140–144) may be used for different reel (e.g., 12–16). Alternatively, a single map may be used to map each of the virtual stops to one of the physical stops on the reels 12–16. Additionally, while only one reel strip is shown in FIG. 3, it should be understood that various different types of reel strips might be used.

While prior systems have only used maps that relate random numbers directly to reels (e.g., a first random number corresponded to a first map that corresponded to a first reel, a second random number corresponded to a second map that corresponded to a second reel, etc.), as disclosed herein, random numbers may be associated with maps, which may be randomly selected to correspond to reels. For example, while prior systems have commonly mapped the longest odds to the last reel (i.e., the rightmost reel from the perspective of a user), the present invention may randomly map the longest odds to different reels in a random manner on subsequent game plays. In prior systems, a user that repeatedly received a high payout symbol on the first two reels and then did not win due to having the "wrong symbol" appear on the third reel may have become frustrated with the third reel and may potentially think that the gaming apparatus is broken or "rigged" and may then leave the machine. In accordance with certain aspects of the present invention, the "wrong symbol" may randomly or pseudorandomly appear on each of the first, middle and last reels on subsequent game plays so that the user does not begin to think that the gaming apparatus is broken or "rigged." For example, in one particular game the map to reel correspondence maybe as follows: the first map 140 corresponds to the middle reel 14, the second map 142 corresponds to the last reel 16 and the third map 144 corresponds to the first reel 12. On another play of the game, the first map 140 may correspond to the first reel 12, while the second and third maps 142, 144 may correspond to the last and middle reels 16, 14, respectively.

As will be readily appreciated, the assignments of maps to reels may be random, wherein each random number and map have an equal probability of corresponding to each reel. Alternatively, the assignments of random numbers and maps to reels may be pseudorandom, wherein particular random numbers and maps are weighted to be more likely to correspond to particular maps and reels.

Alternatively, as disclosed herein, maps may be assigned to reels in a fixed manner and random numbers may be randomly associated with each map. For example, a first random number may be associated with one of the maps, which may be associated with a reel on a fixed basis (i.e., maps are assigned to reels in a fixed manner). In such an arrangement, the long odds reel does not appear to move between the first, middle and last reels, however, the apparent randomness of the game outcome increases because the random numbers are randomly assigned to reels. Further detail regarding the assignments of numbers to maps and of maps to reels is provided hereinafter.

Figure 4A:
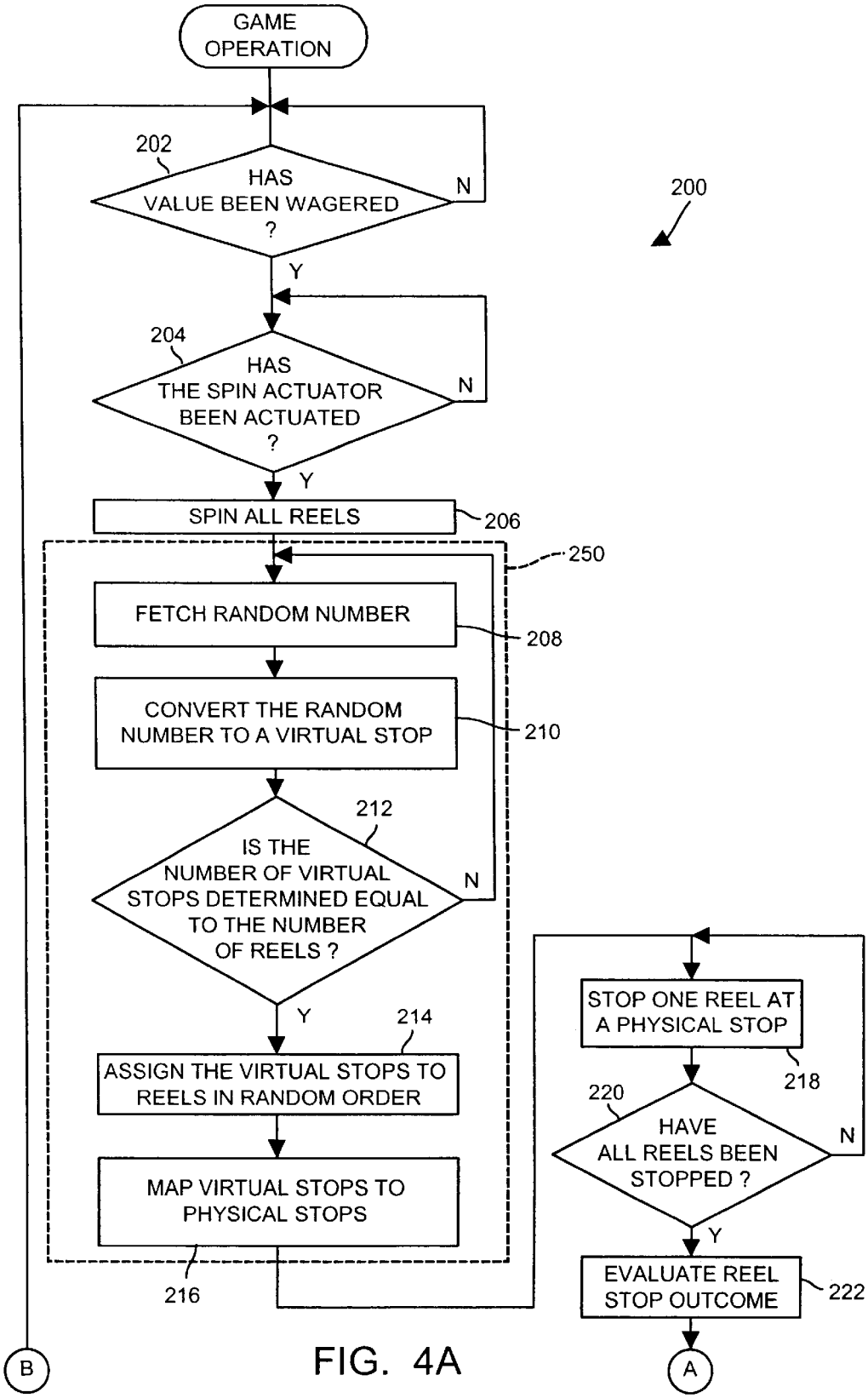
FIGS. 4A and 4B are exemplary flow diagrams of a reel mapping process that may be implemented on the hardware of FIG. 2.
Figure 4B:
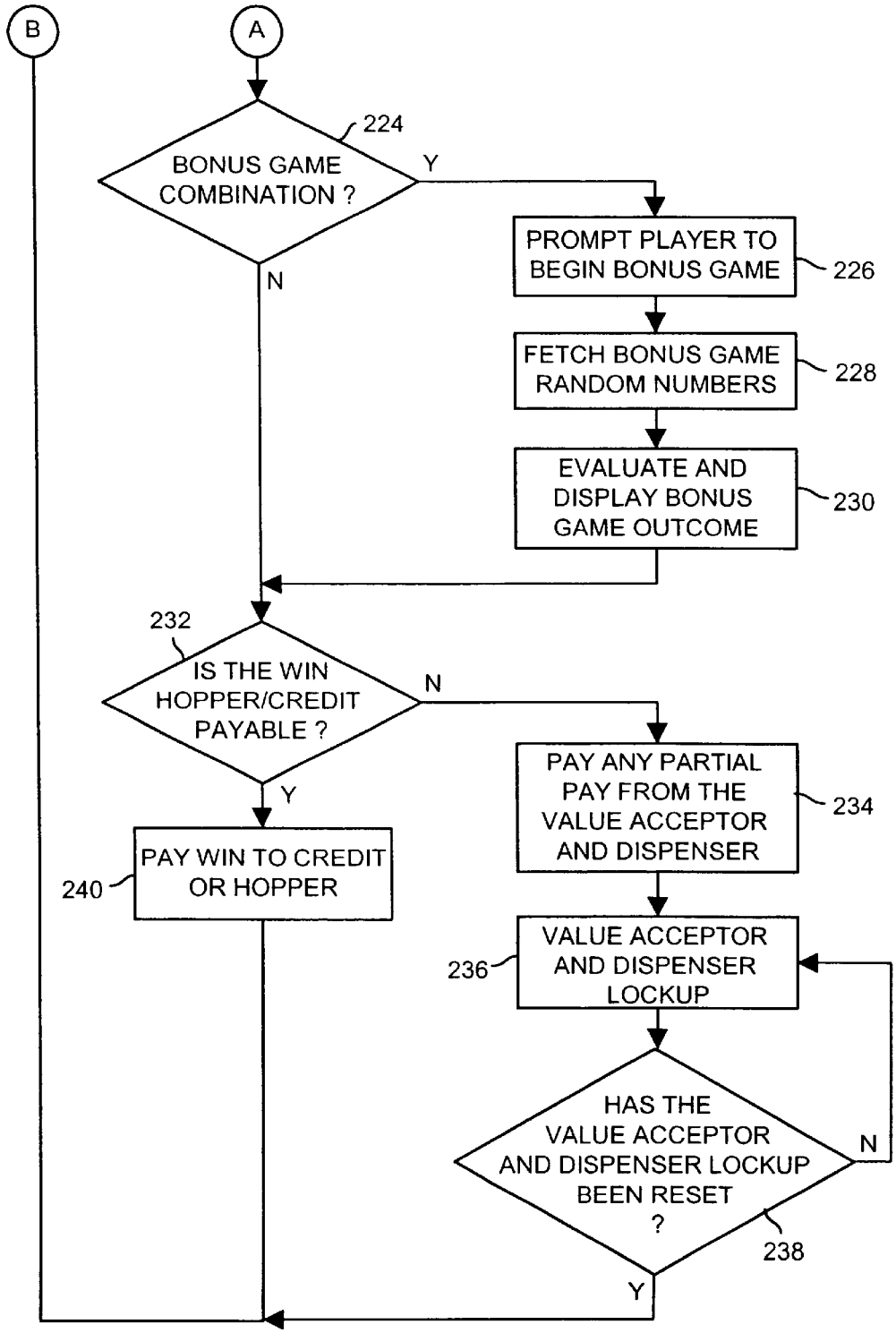

As shown in FIGS. 4A and 4B (referred to collectively herein as FIG. 4), a game operation process 200 may include a number of blocks that may be embodied in instructions stored on the program memory 82 and executed by the controller 76 to carry out the functionality of the gaming apparatus 10. Such instructions may be written in C, C++ or any other suitable language that may be compiled into a format that is executable by the controller 76. Alternatively, the instructions may be written in assembly, machine language or any other suitable form.

Figure 5:
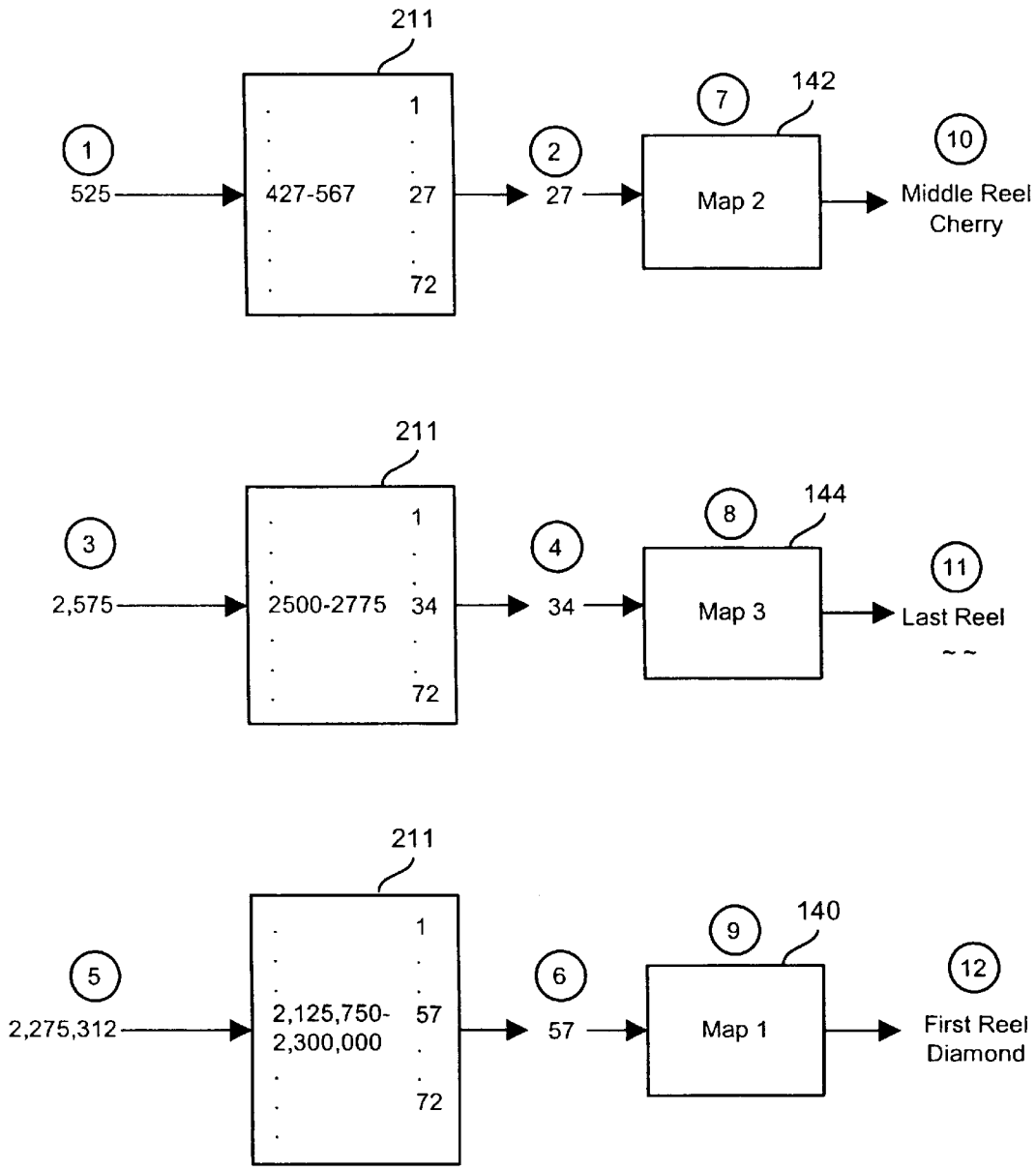
FIG. 5 is an exemplary illustration of the operation of the reel mapping process of FIGS. 4A and 4B.

The description of the execution of the process 200 is provided hereinafter with respect to FIGS. 4A, 4B and 5. The encircled numerals shown in FIG. 5 represent a sequence in which various events may occur as the process 200 of FIG. 4 is executed. At a block 202, the process 200 may wait for a user to wager value to begin a new game. Control remains at the block 202 as long as a user has not wagered value. When value has been wagered, control may pass from the block 202 to the block 204, which determines if the spin actuator 20, 22 has been actuated. If the spin actuator 20, 22 has not been actuated, control remains at the block 204. If, however, the spin actuator 20, 22 has been actuated, control passes to a block 206, which may cause all reels 12–16 of the gaming apparatus 10 to spin.

After the block 206 starts the reels 12–16 spinning, control passes to a block 208, which fetches a random number, which may, for example, be between 1 and 4,294,967,295, before passing control to a block 210. For purposes of this example, as shown in FIG. 5, the first random number will be assumed to be 525. The block 210 converts the random number generated by the block 208 into an intermediate number, referred to as a virtual stop, between, for example, 1 and 72 such as, in this example, 27. Such a conversion may be carried out using a lookup table 211, a scaling down algorithm or any other suitable technique used by those having ordinary skill in the relevant art. A scaling down process is an algorithm that is applied to a random number that is between, for example, 1 and 4,294,967,295 to scale the random number down to a number between, for example, 1 and 72.

After the block 210 completes execution, control may pass to a block 212, which determines whether the number of virtual stops that have been determined is equal to the number of reels 12–16 of the gaming apparatus 10. If the number of virtual stops that have been determined is not equal to the number of reels 12–16, control may pass back to the block 208. The repeated execution of the blocks 208–212 results in the selection of three random numbers (e.g., 525; 2,575 and 2,275,312) and further results in each of the selected random numbers being converted to virtual stops (e.g., 27, 34 and 57). The results of the steps of selecting three random numbers and mapping those numbers to virtual stops are shown in FIG. 5 at encircled numerals 1–6. If, however, the number of virtual stops is equal to the number of reels, control passes from the block 212 to a block 214.

The block 214 may assign the virtual stops to all of the reels in a random or pseudorandom order. For example, as shown in FIG. 5, the first, second and third virtual stops may be assigned to the middle, last and first reels 14, 16, 12, respectively, as shown by the encircled numerals 7–9, respectively, by second, third and first maps 142, 144, 140. After the first virtual stop has been assigned to one of the reels, the second virtual stop may be assigned to either of the remaining two reels and, finally, the third virtual stop may be assigned to the remaining reel to which a virtual stop has not been assigned.

After the block 214 has assigned a virtual stop between, for example, 1 and 72 to each of the reels 12–16, control passes to the block 216. The block 216 maps each virtual stop to a physical stop between, for example, 1 and 22, which corresponds to symbols that are disposed on the periphery of the reels 12–16. For example, as shown in FIG. 5, the virtual stop of 27 may be mapped to the middle reel 14 using the second map 142. In such a case, the virtual stop of 27 would be mapped to the CHERRY symbol on the reel strip 150 of the middle reel 14, as shown by the encircled numeral 10. The block 216 continues operation until each of the virtual stops (e.g., 27, 34 and 57) is mapped to physical stops on the reels 12–16. For example, as shown in FIG. 5, the third map 144 and the first map 140 may be used to map the virtual stops of 34 and 57 to the physical stops of a GHOST (~~) and DIAMOND as represented by the encircled numerals 11 and 12.

Because each reel may have 22 stops, the virtual stop between 1 and 72 is reduced to the number of physical locations on a reel. Accordingly, as will be appreciated by one having ordinary skill in the art, if a physical reel has more or fewer physical stops (e.g., symbols disposed thereon) than 22, the block 216 would map the virtual stops to the number of physical stops on that particular reel. Further detail regarding how virtual stops are mapped to physical stops is provided hereinafter. Additionally, U.S. Pat. No. 4,448,419 to Telnaes, which is owned by International Game Technology, the assignee of the present patent, discloses techniques for mapping virtual stop numbers to physical stops on reels.

After the virtual stops corresponding to each of the reels 12–16 have been mapped to physical stops on the reels 12–16 at the block 216, control passes to a block 218. The block 218 stops one of the reels 12–16 at the physical stop that was determined by the block 216. Typically, as will be appreciated by those having ordinary skill in the art, the controller 76 interacts with the motors 40–42 and the encoders 48–52 to stop the reels 12–16 at the appropriate physical stops dictated by the block 216. Accordingly, the CHERRY, ~~ and DIAMOND symbols shown in the example of FIG. 5 will be displayed to the user on the middle reel 14, the last reel 16 and the first reel 12, respectively.

After the block 218 has stopped one of the reels 12–16, control passes to a block 220, which determines if all of the reels 12–16 have been stopped. If all of the reels have not been stopped, control passes back to the block 218, which stops a reel that is still spinning. Commonly, the reels 12–16 are stopped in sequence from left to right, from the perspective of the user. However, any other suitable pattern of stopping the reels 12–16 may be used. If, however, the block 220 determines that all of the reels 12–16 have stopped, control passes from the block 220 to a block 222.

The block 222 evaluates the outcome of the game based on the reel symbols that are displayed to the user. If the combination of symbols displayed to the user corresponds to a bonus game combination, a block 224 passes control to a block 226, which prompts the user to play a bonus game that is based on random numbers and may be represented using graphics such as playing cards or the like. Such bonus games may be played on a video display (not shown) or the like.

After the block 226 prompts the user to play a bonus game, control passes to a block 228, which fetches random numbers that are associated with the bonus game. After the random numbers are fetched by the block 228, a block 230 evaluates the outcome of the bonus game and displays such an outcome to the user.

If, however, the block 224 determines that the symbol combination displayed on the reels 12–16 is not a bonus game combination, control passes from the block 224 to a block 232, which is also the block to which the block 230 passes control after its execution. The block 232 determines if a complete payout (e.g., the distribution of value) is payable from the hopper 32 or payable in credit based on the result of the bonus game. For example, a complete payout may not be payable if the user has won a rather large jackpot or if the gaming apparatus 10 on which the user is playing is not authorized to dispense the amount of value that the user has won.

If the payout is not completely payable by hopper 32 or by credit, a block 234 controls the value acceptor and dispenser 88 (FIG. 2) to distribute any possible partial payment from the hopper 32 or to dispense any possible credit that the gaming apparatus 10 may dispense. After the maximum partial payment of a payout is made, a block 236 locks up the value acceptor and dispenser 88 to prevent any more value from being dispensed to the user. After the partial payment has been made at block 236, a block 238 determines if the value acceptor and dispenser 88 has been reset. Such a reset may be effectuated by casino personnel or any other authorized personnel. As long as the value acceptor and dispenser 88 has not been reset, the block 238 maintains control of the process 200 at the block 236. However, after the value acceptor and dispenser 88 has been reset, control passes from the block 238 to the block 202, which awaits for the next game to be started.

Returning to the description of the block 232, if the entire payout is payable by the gaming apparatus 10, control passes from the block 232 to a block 240, which controls the value acceptor and dispenser 88 to dispense the appropriate value to the user. After winnings have been paid to the user, control passes back to the block 202, which waits for a new game to begin.

Of particular interest in FIG. 4*a* is a reel mapping process 250 that includes the blocks 208–216 shown within the dotted block. The blocks 208–216 of the process 250 function to enhance the appearance of randomness for the gaming apparatus 10 outcome by mapping random numbers to reels in a random manner. Such a technique allows the outcome of the gaming apparatus 10 to appear more random. However, such a technique does not move the "long odds" reel between the reels 12–16 of the gaming apparatus 10. While the blocks 208–216 of the process 250 illustrate one manner in which the appearance of randomness may be enhanced, those skilled in the art will readily recognize that other, and different, techniques may be used.

Figure 6:
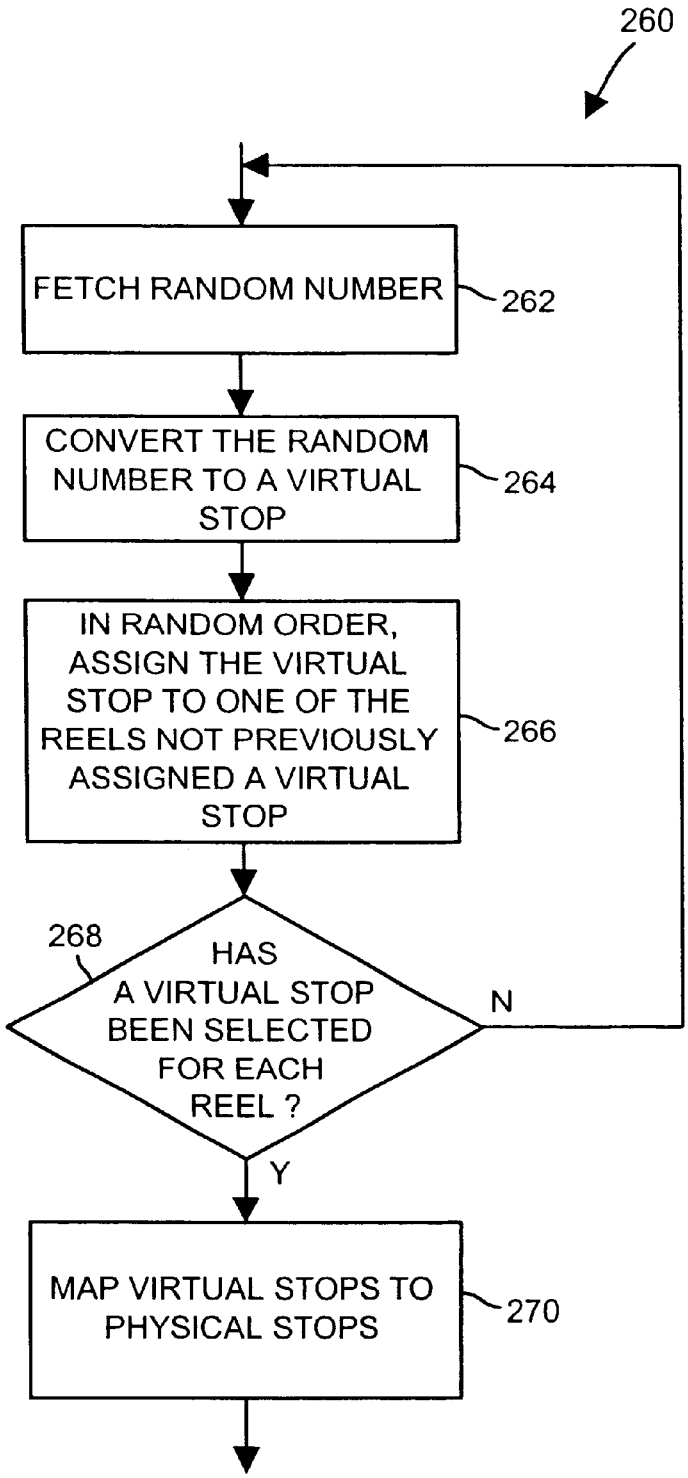
FIG. 6 an exemplary flow diagram of a second reel mapping process that may be implemented on the hardware of FIG. 2.

One alternate reel mapping process 260 for enhancing the appearance of randomness without moving the long odds reel between the reels 12–16 is shown in FIG. 6. The operation of the process 260 will be described in conjunction with FIG. 7, in which encircled numerals are used to denote the various steps carried out by the process 260. In practice, the blocks of the process 260 shown in FIG. 6 may be substituted into FIG. 4 for the blocks 208–216 of the process 250.

Figure 7:
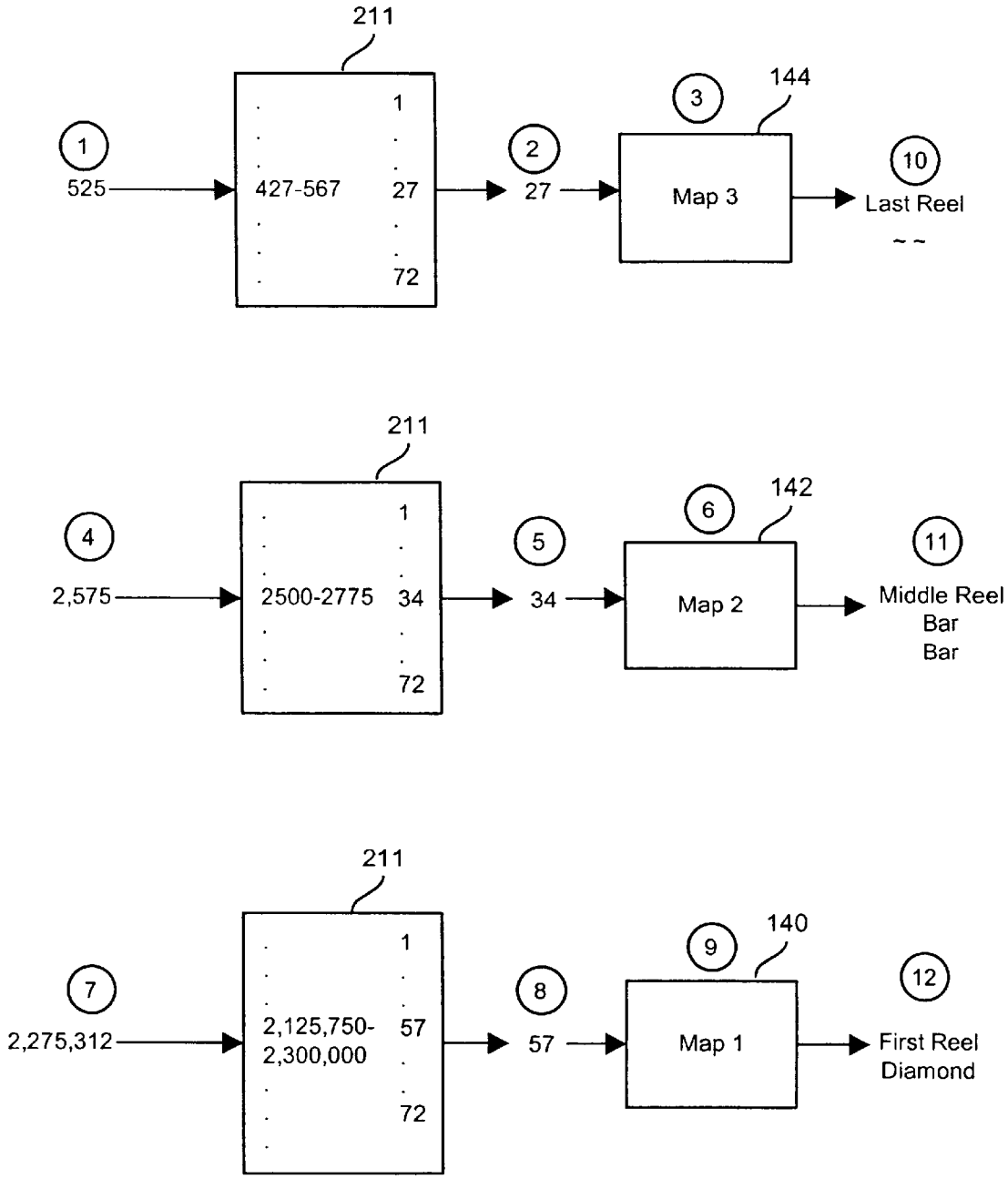
FIG. 7 is an exemplary illustration of the operation of the reel mapping process of FIG. 6.

The execution of the process 260 begins at a block 262, which, like the block 208 of FIG. 5, fetches a random number that may be, for example, between 1 and 4,294,967, 295. For example, as shown in FIG. 7 at the encircled numeral 1, the random number may be 525. After the block 262 fetches a random number, control passes to a block 264, which converts the random number to an intermediate number or virtual stop between 1 and 72. The block 264 may execute in a manner that is similar to that of block 210 (FIG. 4). For example, as shown in FIG. 7, the random number of 525 may be converted to a virtual stop of 27 through the use of lookup table 211.

After the execution of the block 264, a block 266 assigns, in random or pseudorandom order, the virtual stop from the block 264 to one of the reels 12–16 that has not been assigned a virtual stop, wherein each reel 12–16 has a map 140–144 substantially permanently associated therewith. For example, as shown in FIG. 7 at the encircled numeral 3, the virtual stop of 27 may be assigned to the last reel 16 through the third map 144. After the virtual stop (e.g., 27) has been assigned to one of the reels 12–16, a block 268 determines if virtual stops have been assigned to each of the reels 12–16. If each reel 12–16 has not been assigned a virtual stop, control passes back to the block 262. Accordingly, at the encircled numerals 4–6, a second random number having a value, for example, of 2,575, may be selected, may be converted to a virtual stop of 34 via the lookup table 211 and the virtual stop may be assigned to the middle reel 14 via the second map 142. Further, at the encircled numerals 7–9, a third random number of, for example, 2,275,312 may be selected, may be mapped to a virtual stop of 58 via the lookup table 211 and the virtual stop may be assigned to the first reel 12 via the first map 140.

If, however, a virtual stop has been assigned to each reel 12–16, control passes from the block 268 to a block 270. In a manner similar to that carried out by the block 216 of FIG. 4, the block 270 maps the virtual stops of each of the reels 12–16 to physical stops for those reels. For example, as shown in FIG. 7 at the encircled numerals 10–12, the virtual stops of 27, 34 and 57 may be mapped to the last reel 16, the middle reel 14 and the first reel 12, respectively, using the third map 144, the second map 142 and the first map 140, respectively. Accordingly, the virtual stops of 27, 34 and 57 will be mapped to the physical stop corresponding to ~~, BAR BAR and DIAMOND on the reel strip 150. The block 270 may be carried out in a fashion similar to that of 216 of FIG. 4. After the block 270 completes execution, control passes to the block 218 (FIG. 4).

Figure 8:
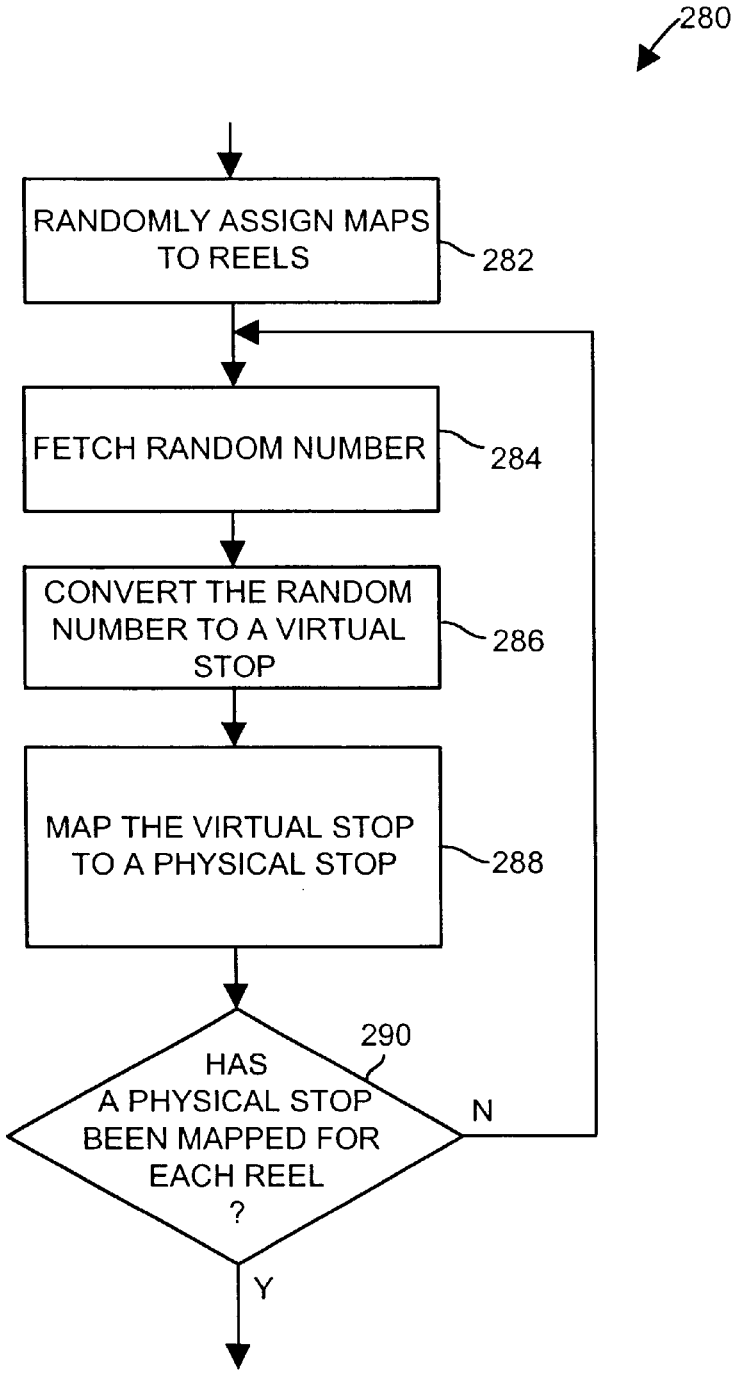
FIG. 8 is an exemplary flow diagram of a third reel mapping process that may be implemented on the hardware of FIG. 2.
Figure 9:
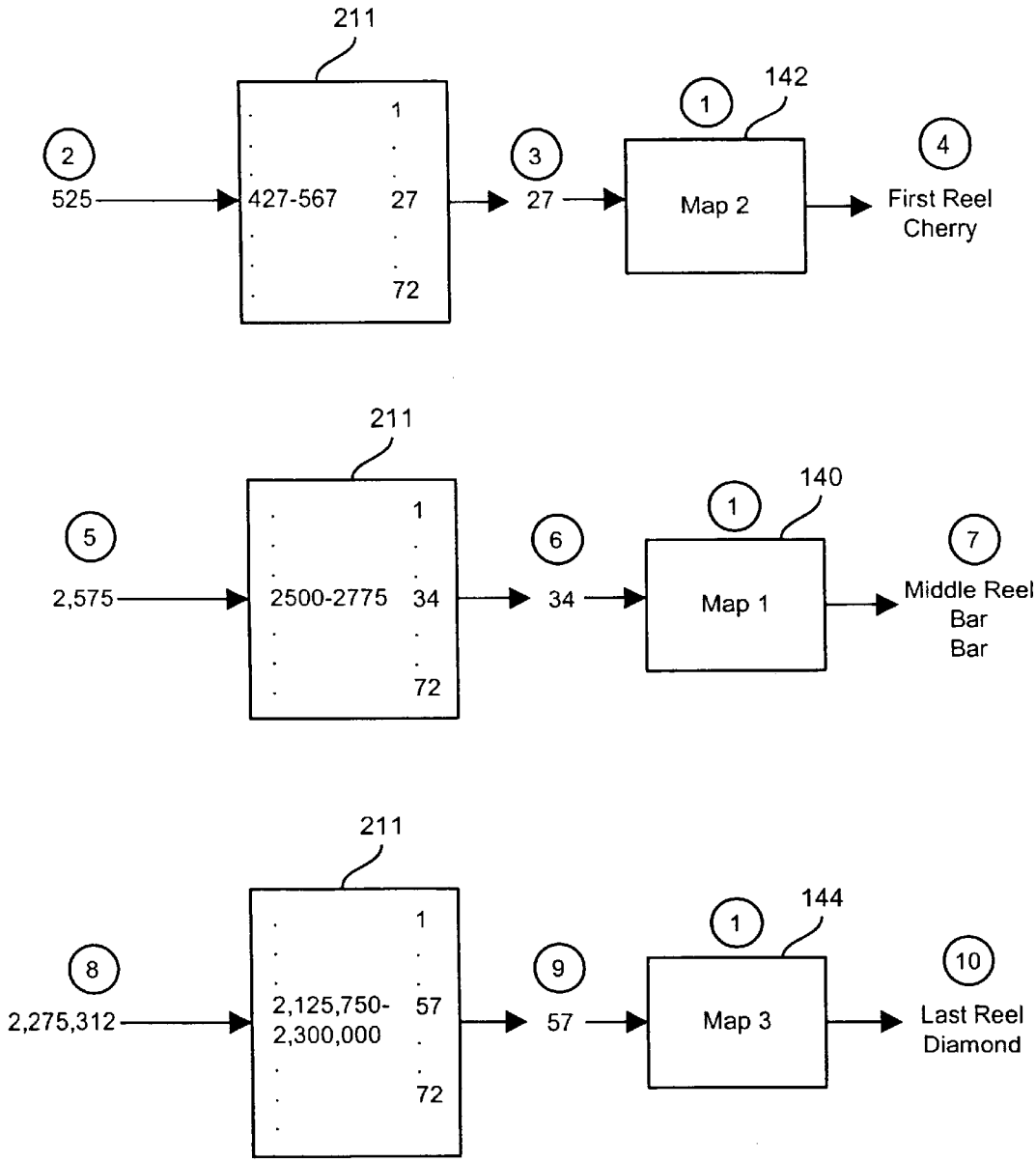
FIG. 9 is an exemplary illustration of the operation of the reel mapping process of FIG. 8.

A reel mapping process 280 that moves the long odds reel among the reels 12–16 is shown in FIG. 8 and will be described in conjunction with FIG. 9. Essentially, the process 280 operates by randomly assigning maps to reels, rather than maps being substantially permanently assigned to reels. Such a process 280, like the process 260, may be substituted into the process 200 for the blocks shown within the dotted block 250. The process 280 may begin execution at a block 282, which randomly assigns each one of the three maps 140–144 to each one of the reels 12–16. For example, as shown in FIG. 9 at the encircled 1 numerals, the second map 142, the first map 140 and the third map 144, may be assigned to the first reel 12, the middle reel 14 and the last reel 16, respectively. After the maps 140–144 have been assigned to the reels 12–16, control passes from the block 282 to a block 284. As will be readily appreciated by those having ordinary skill in the art, the assignments of maps to reels may be purely random or may be weighted to have an outcome that is not evenly distributed.

Like the blocks 208 and 262 of FIGS. 4 and 6, respectively, the block 284 generates a random number such as, for example 525, which is shown in FIG. 9 at the encircled numeral two. After the random number is generated, control passes to a block 286, which converts the random number to a virtual stop between 1 and 72. For example, as shown in FIG. 9 at the encircled numeral three, the lookup table 211 may convert the random number of 525 to a virtual stop of 27. The execution of the block 286 is similar to that described in connection with blocks 210 and 264 of FIGS. 4 and 6, respectively.

After the block 286 converts the random number to a virtual stop, a block 288 maps the virtual stop to a physical stop on a reel 12–16 not yet assigned a physical stop. For example, as shown in FIG. 9 at the encircled numeral 4, the virtual stop of 27 may be converted into the physical stop corresponding to the CHERRY symbol on the first reel 12 via the second map 142.

After the block 288 has executed, a block 290 determines whether all reels 12–16 have had physical stops mapped thereto. If there are remaining reels 12–16 not having physical stops mapped thereto, control passes back to the block 284, which repeats the random number selection, virtual stop conversion and physical stop mapping blocks (i.e., blocks 284–288). Accordingly, as shown in FIG. 9 at the encircled numerals 5–8, a random number of 2,575 may be converted to a virtual stop of 34, via the lookup table 211, and the virtual stop of 34 may be mapped to the physical stop corresponding to the BAR BAR symbol on the middle reel 14 via the first map 140. Additionally, as shown at the encircled numerals 8–10, a random number of 2,275,312 may be converted to a virtual stop of 57, via the lookup table 211, and the virtual stop of 57 may be mapped to a physical stop corresponding to the DIAMOND symbol on the last reel 16 via the third map 144.

If, however, all of the reels 12–16 have physical stops mapped thereto, the block 290 passes control from the process 280 to the block 218 (FIG. 4) so that the reels 12–16 may be stopped and the results of the game displayed to the user.

Figure 10:
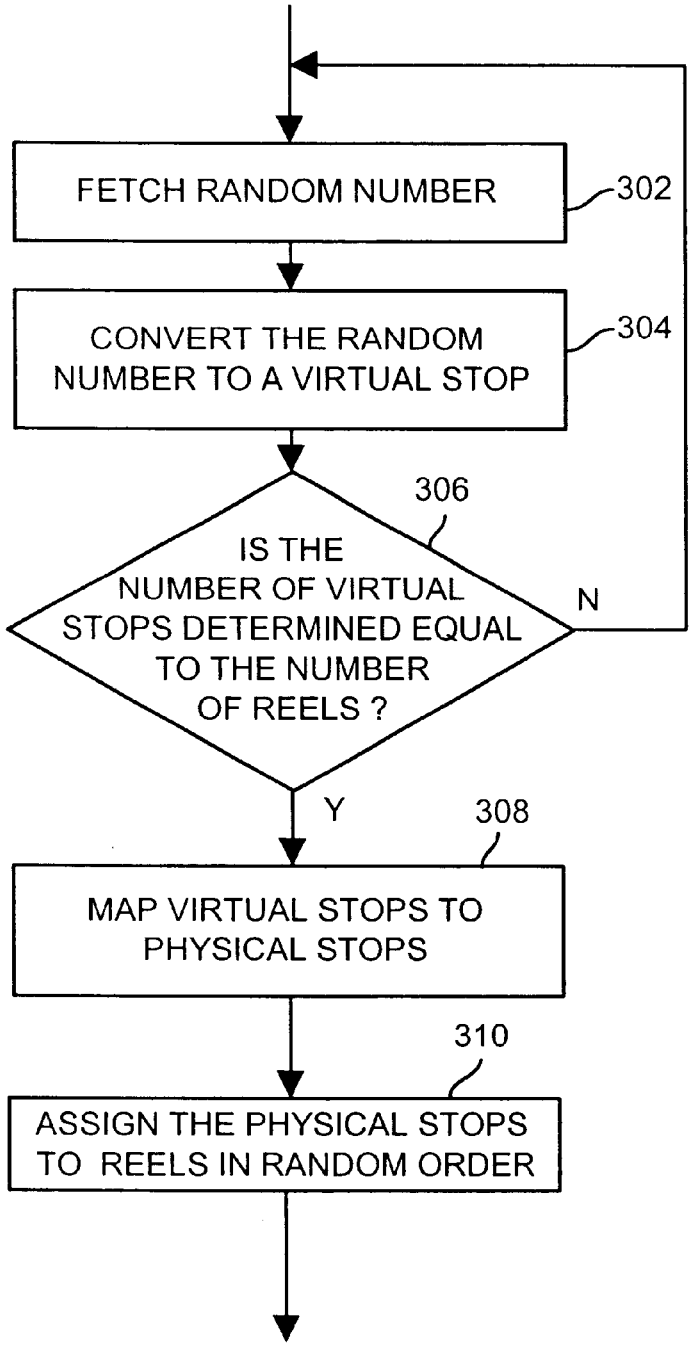
FIG. 10 is an exemplary flow diagram of a fourth reel mapping process that may be implemented on the hardware of FIG. 2.
Figure 11:
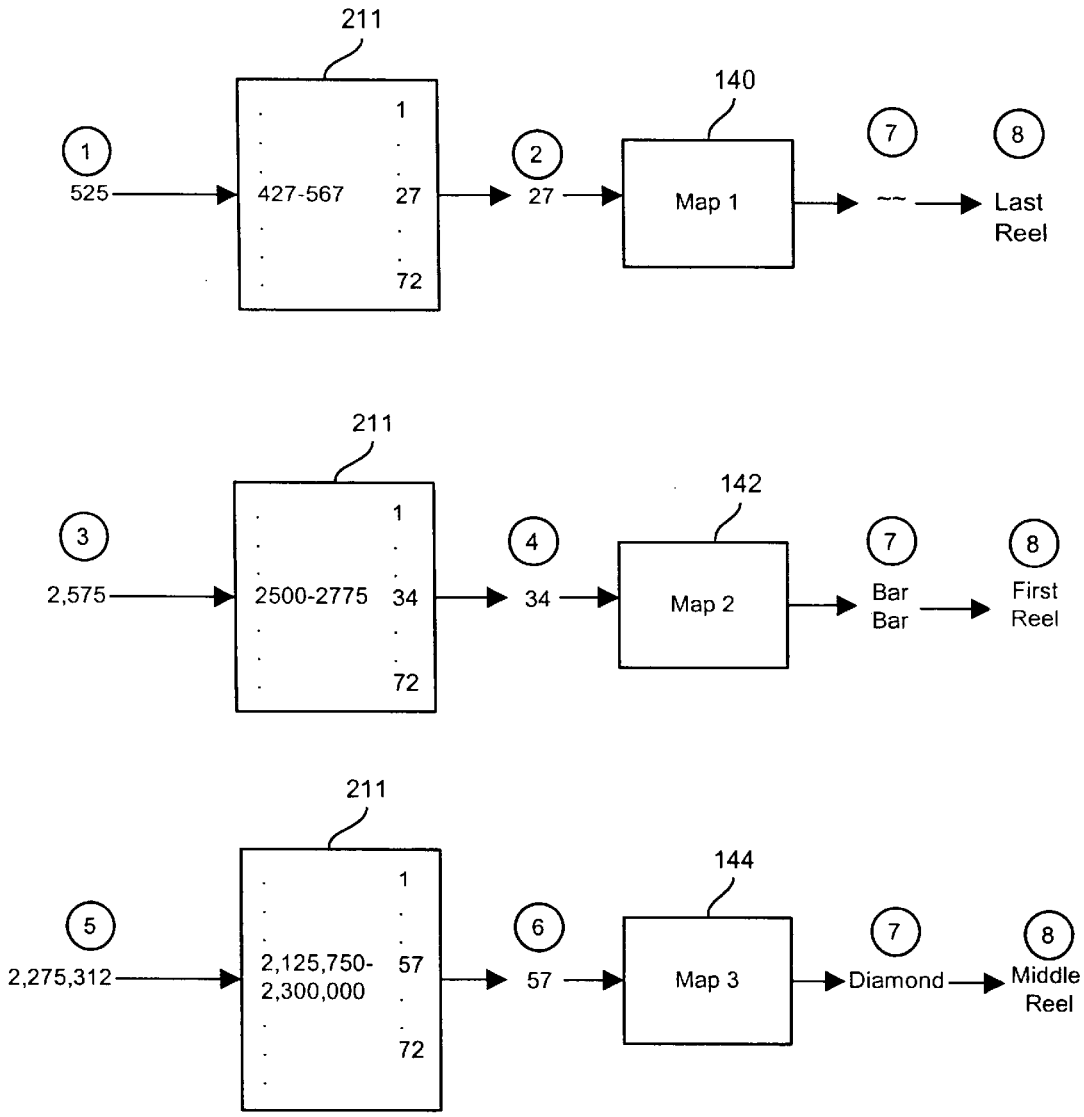
FIG. 11 is an exemplary illustration of the operation of the reel mapping process of FIG. 10.

An alternate reel mapping process 300 that moves the long odds reel among the reels 12–16 is shown in FIG. 10 and will be described in conjunction with FIG. 11. The process described herein with respect to FIGS. 10 and 11 assumes that each of the reels 12–16 of the gaming apparatus 10 have identical symbols thereon. As will be readily appreciated, in situations in which a subset of reels are identical, the process described in connection with FIGS. 10 and 11 may be used on the subset of identical reels. Essentially, the process 300, like the process 280, operates by randomly assigning maps to reels, rather than maps being substantially permanently associated with reels. The process 300, like the processes 260 and 280, may be substituted into the process 200 for the blocks shown within the dotted block 250. The process 300 may begin execution at a block 302, which like the blocks 208 and 262 of FIGS. 4 and 6, respectively, generates a random number such as, for example 525, which is shown in FIG. 11 at the encircled numeral 1. After the random number is generated, control passes to a block 304, which converts the random number to a virtual stop between 1 and 72. For example, as shown in FIG. 11 at the encircled numeral 2, the lookup table 211 may convert the random number of 525 to a virtual stop of 27. The execution of the block 304 is similar to that described in connection with blocks 210 and 264 of FIGS. 4 and 6, respectively.

After the block 304 converts the random number to a virtual stop, a block 306 determines if additional virtual stops need to be determined. If additional virtual stops need to be determined, the block 306 passes control back to the block 302. If, however, the block 306 determines that no more virtual stops need to be determined, control passes to a block 308. Before the block 306 determines that no additional virtual stops need to be determined, second and third random numbers are mapped to virtual stops, as shown in FIG. 11 at encircled numerals 3–6.

The block 308, as shown in FIG. 11 at encircled 7 numerals, converts the virtual stops of 27, 34 and 57 into physical stops of GHOST, BAR BAR and DIAMOND via the first, second and third maps 140–144, respectively. After the block 308 has completed execution, control passes to a block 310.

The block 310 maps the physical stops of GHOST, BAR BAR and DIAMOND to the last, first and middle reels 16, 12, 14 in random order as shown in FIG. 11 at the encircled 8 numerals. For example, as shown in FIG. 11, the GHOST symbol has been randomly assigned to the last reel 16, the BAR BAR symbol has been randomly assigned to the first reel 12 and the DIAMOND symbol has been randomly assigned to the middle reel 14. Alternatively, the block 310 could be omitted and a block that randomly assigns maps to reels could be added between blocks 306 and 308, before virtual stops are mapped to physical stops.

Accordingly, as disclosed herein, random numbers may be randomly associated with or assigned to the first, middle and last reels. Further, the long odds reel may be randomly moved between the first, middle and last reels.

While the blocks of FIGS. 4, 6, 8 and 10 are shown as being executed in exemplary orders, those having ordinary skill in the art will readily appreciate that such execution orders are merely exemplary and should not be considered as limiting in any way.

As used with reference to reel mapping herein, the term "in random order" may include randomly or pseudorandomly selecting a reel from available reels that have not been assigned virtual stops. Further "in random order" may include using a table containing a list of all the random order virtual stop assignment combinations for the number of reels and randomly selecting an assignment order from the table prior to assigning virtual stops. Additionally, "in random order" may include creating a random order of assignment for virtual stops prior to assigning a virtual stop.

Numerous modifications and alternative embodiments of the invention will be apparent to those skilled in the art in view of the foregoing description. Accordingly, this description is to be construed as illustrative only and not as limiting to the scope of the invention. The details of the structure may be varied substantially without departing from the spirit of the invention, and the exclusive use of all modifications, which are within the scope of the appended claims, is reserved.

It is claimed:

1. A method for use in a gaming apparatus having a plurality of reels, each reel having a plurality of physical stops associated with a plurality of symbols, for mapping random numbers to the plurality of physical stops on the plurality of reels, the method comprising:

receiving a user input indicating a desire to start a game;

spinning the plurality of reels;

generating a random number;

associating the random number with a randomly selected reel of the plurality of reels;

mapping the random number to one of the plurality of physical stops on the randomly selected reel;

stopping the plurality of reels from spinning so that the symbols on the reels indicate an outcome of the game; and determining the outcome of the game based on the random number and the physical stop to which the random number was mapped.

2. The method of claim 1, comprising mapping the random number to an intermediate number that is randomly associated with the selected reel.

3. The method of claim 2, comprising mapping the intermediate number to one of the plurality of physical stops using a translation map.

4. The method of claim 1, comprising a plurality of translation maps substantially permanently associated with the plurality of reels and used to associate the random number with the selected reel.

5. The method of claim 1, comprising a plurality of translation maps that are randomly associated with the plurality of reels and used to associate the random number with the selected reel.

6. The method of claim 1, comprising weighting a probability that the random number will be associated with the selected reel.

7. A gaming apparatus, comprising:

a plurality of reels;

a plurality of physical stops associated with a plurality of symbols on each of the plurality of reels for displaying an outcome of a game to a user;

a plurality of motors associated with the plurality of reels for spinning the reels;

a user input device for indicating a desire to start a game; and a controller coupled to the plurality of motors and the user input device, the controller including a processor and a program memory, the controller programmed to:

receive a user input indicating a desire to start a game;

spin the plurality of reels;

generate a random number;

associate the random number with a randomly selected reel of the plurality of reels;

map the random number to one of the plurality of physical stops on the randomly selected reel;

stop the plurality of reels from spinning so that the symbols on the reels indicate an outcome of the game; and determine the outcome of the game based on the random number and the physical stop to which the random number was mapped.

8. The gaming apparatus of claim 7, wherein the controller is programmed to map the random number to an intermediate number that is randomly associated with the selected reel.

9. The gaming apparatus of claim 8, wherein the controller is programmed to map the intermediate number to one of the plurality of physical stops using a translation map.

10. The gaming apparatus of claim 7, wherein the controller is programmed to include a plurality of translation maps substantially permanently associated with the plurality of reels and used to associate the random number with the selected reel.

11. The gaming apparatus of claim 7, wherein the controller is programmed to include a plurality of translation maps that are randomly associated with the plurality of reels and used to associate the random number with the selected reel.

12. The gaming apparatus of claim 7, wherein the controller is programmed to weight a probability that the random number will be associated with the selected reel.

13. A programmed memory that is capable of being used in connection with an electronic gambling unit that comprises a processor, a plurality of reels, each reel having a plurality of physical stops associated with a plurality of symbols, for mapping random numbers to the plurality of physical stops on the plurality of reels, the programmed memory comprising:

a first memory portion physically configured in accordance with computer program instructions that would cause the electronic gambling unit to receive a user input indicating a desire to start a game;

a second memory portion physically configured in accordance with computer program instructions that would cause the electronic gambling unit to spin the plurality of reels;

a third memory portion physically configured in accordance with computer program instructions that would cause the electronic gambling unit to generate a random number;

a fourth memory portion physically configured in accordance with computer program instructions that would cause the electronic gambling unit to associate the random number with a randomly selected reel of the plurality of reels;

a fifth memory portion physically configured in accordance with computer program instructions that would cause the electronic gambling unit to map the random number to one of the plurality of physical stops on the randomly selected reel;

a sixth memory portion physically configured in accordance with computer program instructions that would cause the electronic gambling unit to stop the plurality of reels from spinning so that the symbols on the reels indicate an outcome of the game; and a seventh memory portion physically configured in accordance with computer program instructions that would cause the electronic gambling unit to determine the outcome of the game based on the random number and the physical stop to which the random number was mapped.

14. The programmed memory of claim 13, comprising a eighth memory portion physically configured in accordance with computer program instructions that would cause the electronic gambling unit to map the random number to an intermediate number that is randomly associated with the selected reel.

15. The programmed memory of claim 13, comprising a ninth memory portion physically configured in accordance with computer program instructions that would cause the electronic gambling unit to map the intermediate number to one of the plurality of physical stops using a translation map.

16. The programmed memory of claim 13, comprising a tenth memory portion physically configured in accordance with computer program instructions that would cause the electronic gambling unit to substantially permanently associate a plurality of translation maps with the plurality of reels and used to associate the random number with the selected reel.

17. The programmed memory of claim 13, wherein the programmed memory comprises a magnetically readable memory.

18. The programmed memory of claim 13, wherein the programmed memory comprises an optically readable memory.

19. The programmed memory of claim 13, wherein the programmed memory comprises a semiconductor memory.

20. A method for use in a gaming apparatus having a plurality of reels each having a plurality of physical stops associated with a plurality of symbols and a plurality of translation maps for mapping random numbers to the plurality of physical stops on the plurality of reels, the method comprising:

receiving a user input indicating a desire to start a game;

spinning the plurality of reels;

generating a random number;

mapping the random number to an intermediate number;

mapping the intermediate number to one of the plurality of physical stops on a randomly selected reel using one of the plurality of translation maps;

stopping the plurality of reels from spinning so that the symbols on the reels indicate an outcome of the game; and determining the outcome of the game based on the intermediate number and the physical stop to which the intermediate number was mapped.

21. The method of claim 20, further comprising permanently associating the plurality of translation maps with the plurality of reels.

22. The method of claim 20, further comprising randomly associating the plurality of translation maps with the plurality of reels.

23. A gaming apparatus, comprising:

a plurality of reels;

a plurality of translation maps;

a plurality of physical stops associated with a plurality of symbols on each of the plurality of reels for displaying an outcome of a game to a user;

a plurality of motors associated with the plurality of reels for spinning the reels;

a user input device for indicating a desire to start a game; and a controller coupled to the plurality of motors and the user input device, the controller including a processor and a program memory, the controller programmed to:

receive a user input indicating a desire to start a game;

spin the plurality of reels;

generate a random number;

map the random number to an intermediate number;

map the intermediate number to one of the plurality of physical stops on a randomly selected reel using one of the plurality of translation maps;

stop the plurality of reels from spinning so that the symbols on the reels indicate an outcome of the game; and determine the outcome of the game based on the intermediate number and the physical stop to which the intermediate number was mapped.

24. The gaming apparatus of claim 23, wherein the controller is programmed to permanently associate the plurality of translation maps with the plurality of reels.

25. The gaming apparatus of claim 23, wherein the controller is programmed to randomly associate the plurality of translation maps with the plurality of reels.

26. A programmed memory that is capable of being used in connection with an electronic gambling unit that comprises a processor, a plurality of reels each having a plurality of physical stops associated with a plurality of symbols and a plurality of translation maps for mapping random numbers to the plurality of physical stops on the plurality of reels, the programmed memory comprising:

a first memory portion physically configured in accordance with computer program instructions that would cause the electronic gambling unit to receive a user input indicating a desire to start a game;

a second memory portion physically configured in accordance with computer program instructions that would cause the electronic gambling unit to spin the plurality of reels;

a third memory portion physically configured in accordance with computer program instructions that would cause the electronic gambling unit to generate a random number;

a fourth memory portion physically configured in accordance with computer program instructions that would cause the electronic gambling unit to map the random number to an intermediate number;

a fifth memory portion physically configured in accordance with computer program instructions that would cause the electronic gambling unit to map the intermediate number to one of the plurality of physical stops on a randomly selected reel using one of the plurality of translation maps;

a sixth memory portion physically configured in accordance with computer program instructions that would cause the electronic gambling unit to stop the plurality of reels from spinning so that the symbols on the reels indicate an outcome of the game; and a seventh memory portion physically configured in accordance with computer program instructions that would cause the electronic gambling unit to determine the outcome of the game based on the intermediate number and the physical stop to which the intermediate number was mapped.

27. The programmed memory of claim 26, wherein the programmed memory comprises an eighth memory portion physically configured in accordance with computer program instructions that would cause the electronic gambling unit to permanently associate the plurality of translation maps with the plurality of reels.

28. The programmed memory of claim 26, wherein the programmed memory comprises an ninth memory portion physically configured in accordance with computer program instructions that would cause the electronic gambling unit to randomly associate the plurality of translation maps with the plurality of reels.

29. The programmed memory of claim 26, wherein the programmed memory comprises a magnetically readable memory.

30. The programmed memory of claim 26, wherein the programmed memory comprises an optically readable memory.

31. The programmed memory of claim 26, wherein the programmed memory comprises a semiconductor memory.

32. A method for use in a gaming apparatus having first and second reels, each reel having a plurality of physical stops associated with a plurality of symbols, and first and second maps for mapping numbers to the plurality of physical stops on the first and second reels, the method comprising:

receiving a first user input indicating a desire to start a first game;

spinning the first and second reels;

generating a first number;

mapping the first number to a first one of the physical stops on the first reel using the first map;

determining an outcome of the first game;

determining a value payout based on the first game outcome;

receiving a second user input indicating a desire to start a second game;

spinning the first and second reels;

generating a second number;

mapping the second number to a second one of the physical stops on the first reel using the second map;

determining an outcome of the second game; and determining a value payout based on the second game outcome.

33. The method of claim 32, wherein the first and second reels comprise mechanical reels.

34. The method of claim 32, wherein the first and second reels comprise electronic displays.

35. The method of claim 34, wherein the electronic displays comprise light emitting displays.

36. The method of claim 34, wherein the electronic displays comprise liquid crystal displays.

37. A method for use in a gaming apparatus having a plurality of reels each having a plurality of physical stops associated with a plurality of symbols and a plurality of translation maps for mapping random numbers to the plurality of physical stops on the plurality of reels, the method comprising:

receiving a user input indicating a desire to start a game;

spinning the plurality of reels;

generating a random number;

mapping the random number to an intermediate number;

mapping the intermediate number to one of the plurality of physical stops on a selected reel using a randomly selected one of the plurality of translation maps;

stopping the plurality of reels from spinning so that the symbols on the reels indicate an outcome of the game; and determining a value payout based on the outcome of the game.

38. The method of claim 37, wherein the plurality of reels comprises a plurality of mechanical reels.

39. The method of claim 37, wherein the plurality of reels comprises a plurality of electronic displays.

40. The method of claim 39, wherein the electronic displays comprise light emitting displays.

41. The method of claim 39, wherein the electronic displays comprise liquid crystal displays.

42. A gaming apparatus, comprising:

a random number generator;

a first reel display having a plurality of physical stops associated with a plurality of symbols;

a second reel display having a plurality of physical stops associated with a plurality of symbols;

a first map for mapping random numbers from the random number generator to one of the first and second reels;

a second map for mapping random numbers from the random number generator to one of the first and second reels;

a controller coupled to the first and second reel displays, the controller including a processor and a program memory, the controller programmed to:

receive a first user input indicating a desire to start a first game;

spin the first and second reel displays;

generate a first number;

map the first number to a first one of the physical stops on the first reel using the first map;

determine an outcome of the first game;

determine a value payout based on the first game outcome;

receive a second user input indicating a desire to start a second game;

spin the first and second reel displays;

generate a second number;

map the second number to a second one of the physical stops on the first reel using the second map;

determine an outcome of the second game; and determine a value payout based on the second game outcome.

43. The gaming apparatus of claim 42, wherein the first and second reel displays comprise mechanical reels.

44. The gaming apparatus of claim 42, wherein the first and second reel displays comprise electronic displays.

45. A gaming apparatus, comprising:

a plurality of reel displays;

a plurality of translation maps;

a plurality of physical stops associated with a plurality of symbols on each of the plurality of reel displays for displaying an outcome of a game to a user;

a user input device for indicating a desire to start a game; and a controller coupled to the plurality of reel displays and the user input device, the controller including a processor and a program memory, the controller programmed to:

receive a user input indicating a desire to start a game;

spin the plurality of reel displays;

generate a random number;

map the random number to an intermediate number;

map the intermediate number to one of the plurality of physical stops on a selected reel using a randomly selected one of the plurality of translation maps;

stop the plurality of reel displays from spinning so that the symbols on the reel displays indicate an outcome of the game; and determine the outcome of the game based on the intermediate number and the physical stop to which the intermediate number was mapped.

46. The gaming apparatus of claim 45, wherein the controller is programmed to permanently associate the plurality of translation maps with the plurality of reel displays.

47. The gaming apparatus of claim 45, wherein the controller is programmed to randomly associate the plurality of translation maps with the plurality of reel displays.

48. The gaming apparatus of claim 45, wherein the plurality of reel displays comprise mechanical reels.

49. The gaming apparatus of claim 45, wherein the plurality of reel displays comprises a plurality of electronic displays.

* * * * *